US005210007A

United States Patent [19]

Texter et al.

[11] Patent Number: 5,210,007

[45] Date of Patent: May 11, 1993

[54] IMAGE INTENSIFICATION CHEMISTRY WITH BLOCKED INCORPORATED DEVELOPERS

[75] Inventors: John Texter; David Southby; Jared Mooberry; Roland Willis, all of Rochester, N.Y.

[73] Assignee: Eastman Kodak Company, Rochester, N.Y.

[21] Appl. No.: 810,322

[22] Filed: Dec. 19, 1991

[51] Int. Cl.[5] ..... G03C 7/388; G03C 7/407; G03C 5/42; G03C 1/42

[52] U.S. Cl. ..... 430/373; 430/405; 430/959; 430/566; 430/443; 430/943; 430/461; 430/380; 430/505

[58] Field of Search ..... 430/405, 959, 566, 443, 430/943, 373, 461, 380, 505

[56] References Cited

U.S. PATENT DOCUMENTS

| | | | |
|---|---|---|---|
| 4,045,225 | 8/1977 | Shimamura et al. . | |
| 4,157,915 | 6/1979 | Hamaoka et al. . | |
| 4,371,609 | 2/1983 | Kajiwara et al. | 430/373 |
| 4,454,224 | 6/1984 | Brien et al. | 430/393 |
| 4,469,780 | 9/1984 | Hirai et al. | 430/373 |
| 4,474,872 | 10/1984 | Onishi et al. | 430/566 |
| 4,526,860 | 7/1985 | Kitchin | 430/373 |
| 4,737,450 | 4/1988 | Hall et al. | 430/460 |
| 4,948,718 | 8/1990 | Factor et al. | 430/522 |
| 5,019,492 | 5/1991 | Buchanan et al. | 430/543 |

FOREIGN PATENT DOCUMENTS 61-77851 4/1986 Japan .

*Primary Examiner*—Charles L. Bowers, Jr.
*Assistant Examiner*—Mark F. Huff
*Attorney, Agent, or Firm*—Foley & Lardner

[57] ABSTRACT

A color photographic element for use with a latent or silver image intensification or amplification method which incorporates a blocked color developing agent. The color photographic element includes at least one silver halide emulsion layer which includes at least about 70 mole percent chloride and has a concentration of silver within the range of about 0.1 mg/m$^2$ to 2000 mg/m$^2$. The blocked color developing agent is capable of being unblocked during photographic processing by means of reaction with a dinucleophile reagent. A preferred dinucleophile reagent is hydrogen peroxide, which also acts as an oxidant in the latent or silver image intensification method.

18 Claims, No Drawings

IMAGE INTENSIFICATION CHEMISTRY WITH BLOCKED INCORPORATED DEVELOPERS

BACKGROUND OF THE INVENTION

The present invention relates to a blocked developing agent or developing agent precursor which is incorporated in a color photographic material. In particular, it relates to a blocked developing agent which is incorporated in a color photographic material for use with a latent or silver image intensification or amplification method.

Silver halides, due to their favorable photosensitivity and oxidant characteristics, have long been employed in photographic materials to assist in the formation of color dye images. It is desirable, however, to reduce the amount of silver halide necessary to form a certain amount of dye image. Reducing the amount of silver halide reduces the cost of the photographic material, the amount of fix and bleach necessary to process the photographic material and the amount of environmentally harmful waste products. Efforts to reduce the amount of silver halide coated in the photographic material have focused on the so-called image intensification or amplification method, as described, for example, in Japanese Laid-Open Application No. 61/77,851 and U.S. Pat. Nos. 4,526,860, 4,469,780, 4,371,609 and 4,045,225. According to this method, a smaller amount of silver halide than usual is incorporated in the photographic material. This type of photographic material is referred to herein as a "low silver laydown" photographic material. The low silver laydown material is exposed and the silver halide is reduced imagewise to silver metal by a developing agent. An amplifying agent then is brought into contact with a developing agent in the presence of the resulting silver nuclei which act as a catalyst for the oxidation of the developing agent by the amplifying agent. The oxidized developing agent then reacts with couplers to form dye images.

Among known intensifying agents are peroxides, halogenous acids, iodoso compounds and cobalt (III) complexes, of which hydrogen peroxide is said to have higher amplification activity. For example, at page 406 of *History of Color Photography* by J. S. Friedman, there is described a process of oxidizing a paraphenylenediamine color developing agent with hydrogen peroxide in the presence of a silver catalyst.

The latent or silver image amplification method, however, has not yet been put into practical use because of problems existing with the current technology. One difficulty is that in typical amplifying processes the amplifying agent and the developing agent exist together in a bath. The stability or shelf-life of such a mixture, however, is very limited since the developing agent is oxidized by the hydrogen peroxide. To overcome this problem it has been proposed to incorporate the developing agent in the silver halide-containing photographic material. For example, U.S. Pat. No. 4,157,915 describes incorporating carbamate blocked p-phenylenediamines and U.S. Pat. No. 4,371,609 describes incorporating an aromatic primary amine compound.

Previous efforts at incorporating developing agents in the photographic material, though, have caused severe fogging problems, desensitization of the silver halide emulsion, and raw stock storage instability.

A need exists, therefore, for a color developing agent which can be incorporated into a photographic material for use with a silver image amplification method that does not cause fogging or emulsion desensitization. It would be desirable that the oxidation of the incorporated color developing agent be facilitated so as to form indoaniline dyes imagewise using conventionally incorporated couplers.

SUMMARY OF THE INVENTION

These and other needs have been satisfied by providing a color photographic element comprising a support bearing at least one photographic silver halide emulsion layer and an image dye-forming coupler wherein the photographic silver halide in the emulsion comprises at least about 70 mole percent chloride, the concentration of silver in the emulsion layer is within the range of about 0.1 mg/m$^2$ to 2000 mg/m$^2$, and the element includes a blocked color developing agent capable of being unblocked during photographic processing by means of reaction with a dinucleophile reagent, which can also oxidize the unblocked developing agent.

There has also been provided a process of forming a photographic color image in the above-described color photographic element comprising developing the element in the presence of a dinucleophile reagent.

DETAILED DESCRIPTION OF THE PREFERRED EMBODIMENTS

The blocked developing agent according to the present invention offers the advantage of enabling incorporation of a developing agent into a low silver laydown photographic material without causing fogging and desensitization of the silver halide emulsion. Moreover, the inventive developing agent provides the processing advantage that the same compound can be used as both the unblocking reagent and the amplifying or activating agent as described in detail below.

The low silver laydown material utilized according to the present invention includes at least one silver halide photographic emulsion layer. The emulsion comprises at least about 70 mole percent, preferably at least about 95 mole percent, silver chloride and can include one or more other silver halides, such as silver bromide, silver iodide, silver chlorobromide, silver chloroiodide and silver bromoiodide. Typically, color photographic materials contain silver salts in amounts ranging from about 400 to 10,000 mg/m$^2$. The concentration of silver in the emulsion layer according to the present invention, however, is within the range of about 0.1 mg/m$^2$ to about 2000 mg/m$^2$, preferably within the range of about 10 mg/m$^2$ to about 500 mg/m$^2$.

In the following discussion of suitable materials for use in the emulsions according to the present invention, reference will be made to Research Disclosure, December 1989, Item 308119, published by Kenneth Mason Publications Ltd., Emsworth, Hampshire PO107DQ, U.K., the entirety of which is incorporated herein by reference. This publication will be identified hereafter as "Research Disclosure".

The emulsions can include coarse, medium, or fine silver halide grains bounded by 100, 111, or 110 crystal planes. Also useful are tabular grain silver halide emulsions. In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520.

The silver halide emulsions employed in the elements according to the invention can be either negative-working or positive-working. They can form latent images predominantly on the surface of the silver halide grains or predominantly on the interior of the silver halide grains. Preparation of the silver halide emulsions can proceed according to conventional methods, such as single-jet, double-jet, accelerated flow rate and interrupted precipitation techniques.

The silver halide emulsions can be sensitized to a particular wavelength range of radiation, such as the red, blue, or green portions of the visible spectrum, or the other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, or other known spectral sensitizers. Exemplary sensitizers are described in Research Disclosure Section IV and the publications cited therein.

The developing agent incorporated in the color photographic material according to the present invention is blocked with a group that is released upon reaction with a dinucleophile reagent such as the blocking group described in U.S. Pat. No. 5,019,492, which is incorporated herein by reference. A dinucleophile reagent is a compound which contains two nucleophile groups whose structure is represented by the formula I:

$$HNu^1—X^1—Nu^2H \qquad (I)$$

wherein $Nu^1$ and $Nu^2$ are each individually a nucleophilic N, O, S, P, Se, substituted N atom or substituted C atom; and $X^1$ is a chain of j atoms wherein j is 0, 1 or 2.

Illustrative examples of useful dinucleophile reagents are as follows:

| j = 0 | j = 1 | j = 2 |
|---|---|---|
| $H_2O_2$ | $NH_2CONH_2$ | $NH_2CH_2CH_2NH_2$ |
| $NH_2NH_2$ | 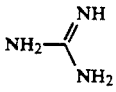 | $NH_2CH_2CO_2H$ |
| $CH_3NHNHCH_3$ | | $NH_2C(CH_3)_2CH_2OH$ |
| $NH_2OH$ | 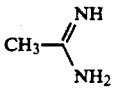 | $NH_2CH_2CH_2SH$ |
| $CH_3\overset{O}{\overset{\|}{C}}—NHOH$ | | 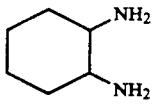 |

The dinucleophile reagent also can be in salt form, such as the acid salts, for example, sulfate or bisulfite salts. Also useful as dinucleophile reagents are derivatives of hydrogen peroxide such as perborates, percarbonates, persulfates, peroxydisulfates, etc. which can hydrolyze to hydrogen peroxide in the processing solution.

The amplifying agent and unblocking agent (dinucleophile) need not be the same species. For example, the amplifying agent could be a derivative of hydrogen peroxide such as a monoalkyl hydroperoxide or a dialkyl peroxide in combination with a non-oxidizing dinucleophile such as a diamine.

Particularly preferred as the dinucleophile reagent is hydrogen peroxide since, as discussed above, hydrogen peroxide also acts as an oxidant for the color developing agent in the amplification process. Utilization of hydrogen peroxide as both the unblocking reagent and the amplifying agent avoids the need for employing two different compounds, one for unblocking and another one for amplifying, in the photographic processing of the color photographic element, thereby simplifying and reducing the cost of the processing.

The blocked developing agent typically is a blocked phenylenediamine or blocked aminophenol color developing agent. Preferably, the blocked color developing agent according to the present invention has a structure represented by the formula II:

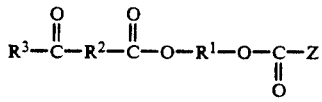

(II)

wherein

Z represents the atoms completing a color developing agent which is releasable from the remainder of the molecule by means of reaction with a dinucleophile reagent;

$R^1$ is an unsubstituted or substituted alkylene or arylene group;

$R^2$ is a substituted or unsubstituted carbon or nitrogen atom that provides a distance between the carbonyl groups that enables a nucleophilic displacement reaction to occur upon processing a photographic element containing the blocked developing agent in the presence of a dinucleophile reagent; and $R^3$ is an unsubstituted or substituted alkyl or aryl group, or represents with $R^2$ the atoms necessary to complete a 5- or 6-member heterocyclic ring.

Preferred embodiments of the blocked developing agent have structures represented by the following formula III and formula IV, respectively:

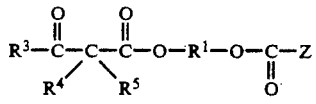

(III)

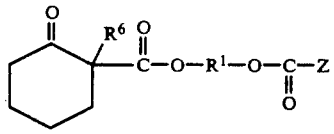

(IV)

wherein $R^4$, $R^5$ and $R^6$ are each individually an alkyl group, preferably having 1 to 3 carbon atoms, an aryl group, an arylalkyl group, an alkoxy group or an alkoxyaryl group.

A low silver laydown material which includes a blocked developing agent as described above has both improved storage stability and a more rapid release upon processing of the active developing agent. In the past it was possible for blocked photographically useful compounds, such as developing agents, to react with nucleophilic compounds containing one nucleophilic group, such as methylamine, hydroxide or water, thereby reducing the storage stability of the photographic material. The blocked developing agent for use in the present invention is not unblocked and activated upon reaction with a nucleophilic compound containing only one nucleophilic group. Rather, activation occurs only upon reaction with a dinucleophile reagent.

The developing agent moiety represented by Z in formula II can be any color developing agent but preferably is either a known phenylenediamine or aminophenol color developing agent. Particularly advantageous are p-phenylenediamines having a structure represented by the formula V:

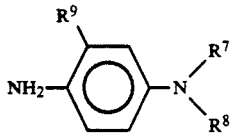

(V)

wherein $R^7$, $R^8$ and $R^9$ are each individually a hydrogen atom, an alkyl group having 1 to 4 carbon atoms or a hydroxyalkyl, alkylsulfonamidoalkyl or alkoxyalkyl group having 1 to 4 carbon atoms. Especially preferred are developers of the formula VI:

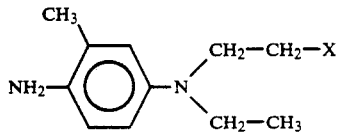

(VI)

n which X is —OH —$NHSO_2CH_3$, —$OCH_3$ or —H.

The preferred aminophenols have a structure represented by the formula VII:

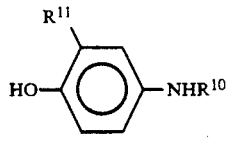

(VII)

wherein $R^{10}$ is a hydrogen atom or an alkyl group having 1 to 4 carbon atoms and $R^{11}$ is a hydrogen atom, one or more halogen atoms or an alkyl group having 1 to 4 carbon atoms.

$R^1$ of formula II preferably is a methylphenylene group having a structure represented by the formula VIII:

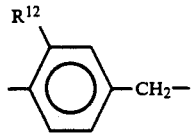

(VIII)

wherein $R^{12}$ is a hydrogen atom, a halogen atom or an alkyl, aryl, alkoxy, amido or sulfonamido group.

The mobility or diffusion of the blocked developing agent in the low silver laydown photographic element prior, during and after processing can be controlled via attachment of at least one ballast group to the blocked developing agent molecule. $R^3$ can be a ballast group and/or the ballast groups can be attached to Z, $R^1$ and/or $R^2$. The use of ballast groups to control diffusion of a photographically useful group is described, for example, in U.S. Pat. Nod. 4,420,556 and 4,923,789, which are incorporated herein by reference. Exemplary ballast groups include a long-chain unsubstituted alkyl group, for example, one having 5 to 40 carbon atoms, an arylalkyl group, or an alkoxyaryl group in which the aryl moiety can be unsubstituted or substituted. The ballast groups can be further modified, for example, by the substitution of a sulfonamido (—$NHSO_2$—) group for a methylene (—$Ch_2$—) group.

Exemplary blocked developing agents useful according to the present invention are given below:

1)

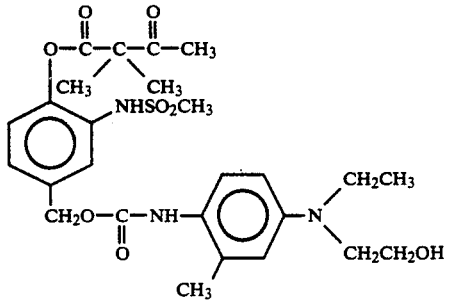

2)

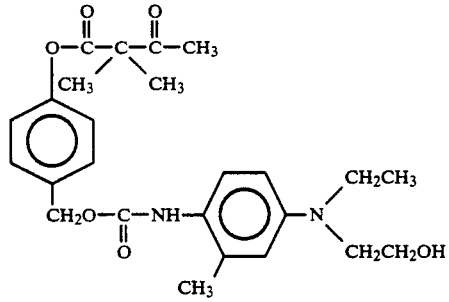

3)

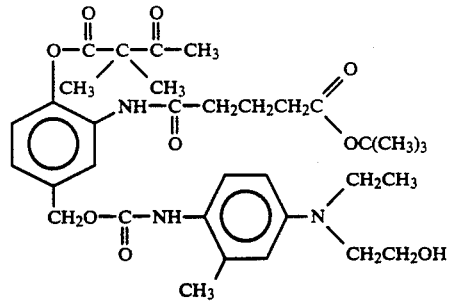

4)

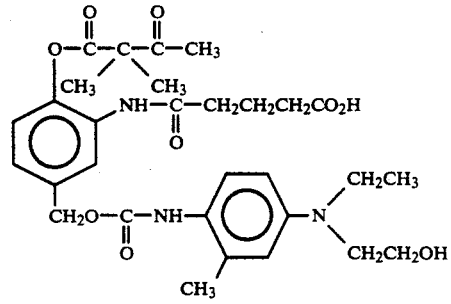

-continued
5)
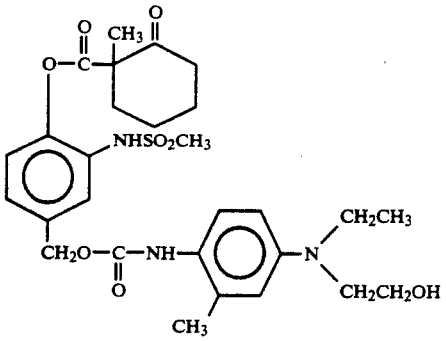
6)
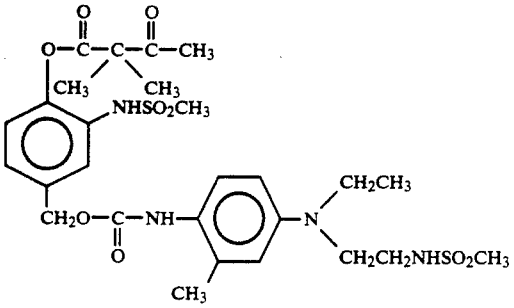
7)
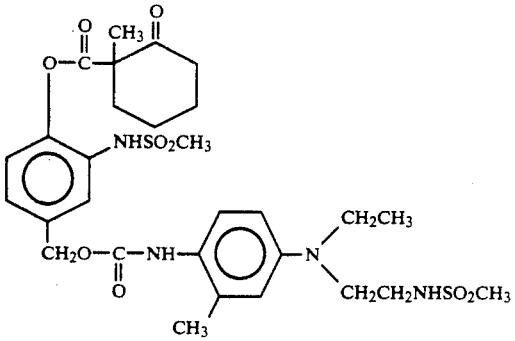
8)
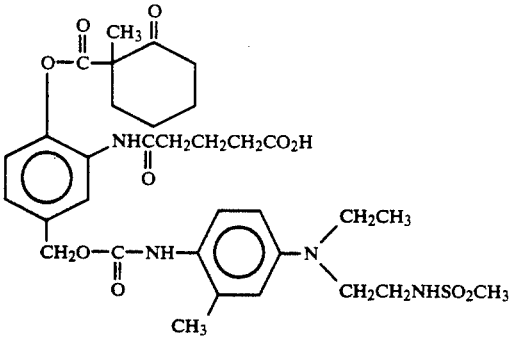
9)
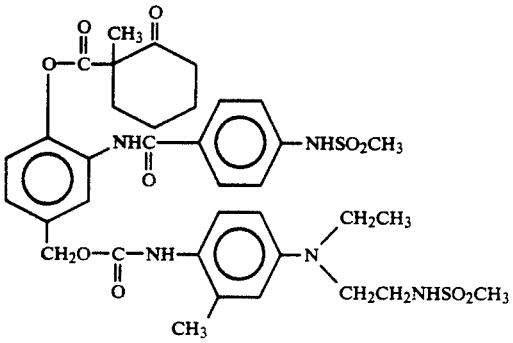
-continued
10)
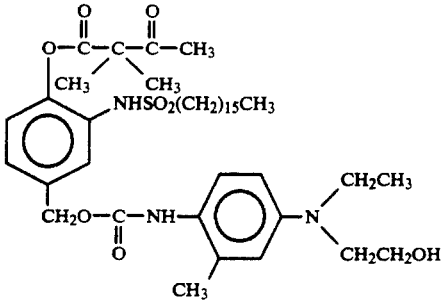
11)
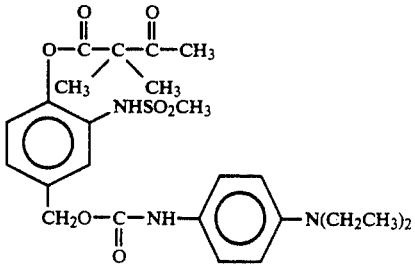
12)
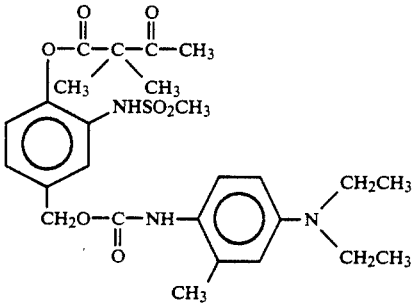
13)
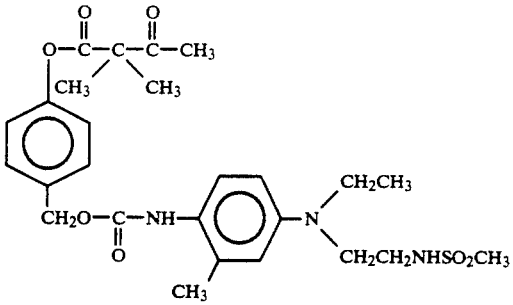
14)
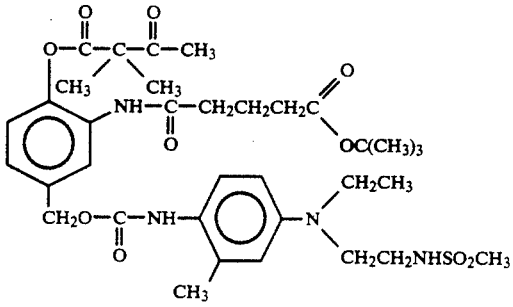

-continued
15)
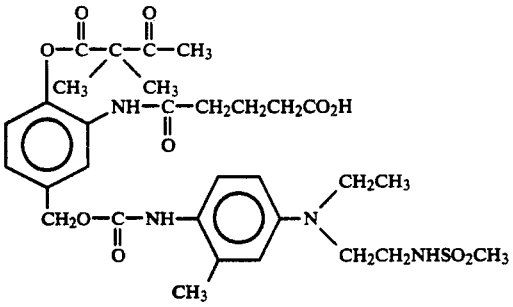
16)
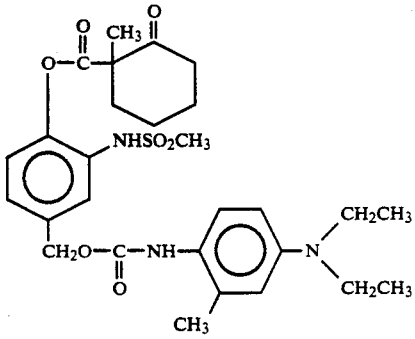
17)
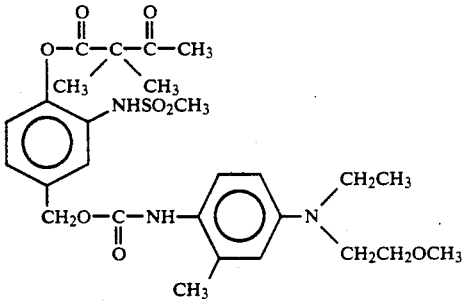
18)
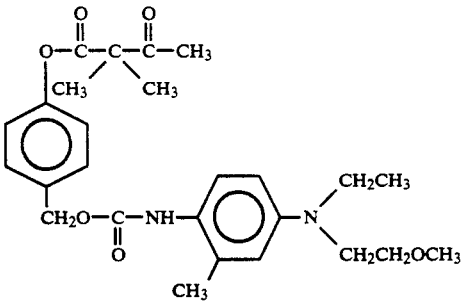
19)
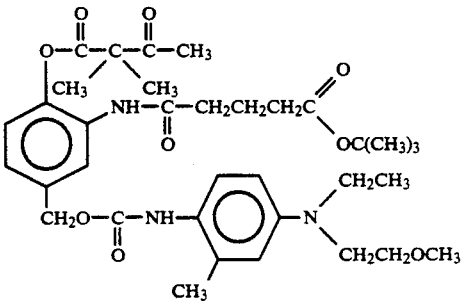
-continued
20)
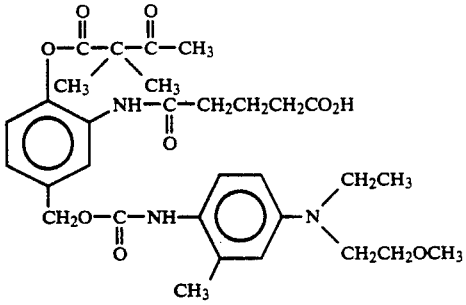
21)
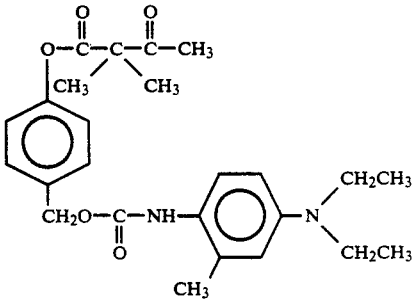
22)
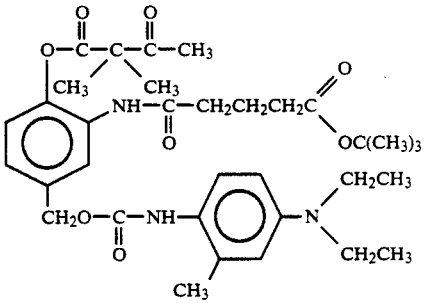
23)
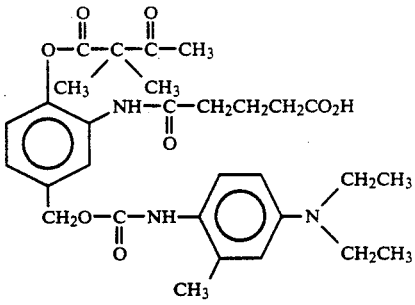
24)
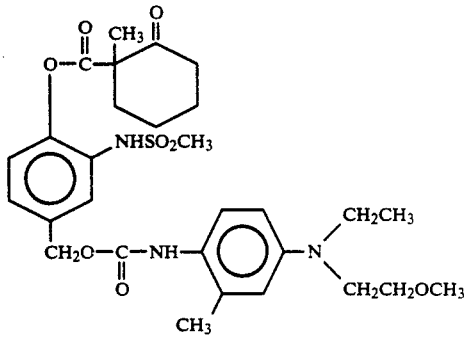

-continued
25)
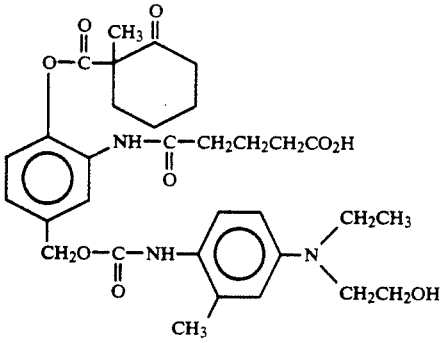
26)
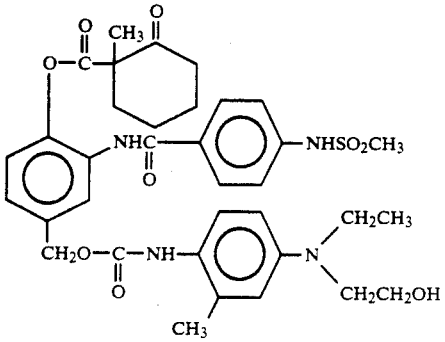
27)
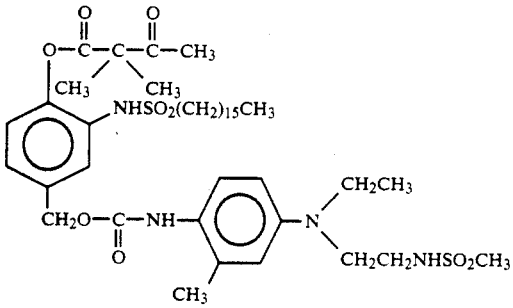
28)
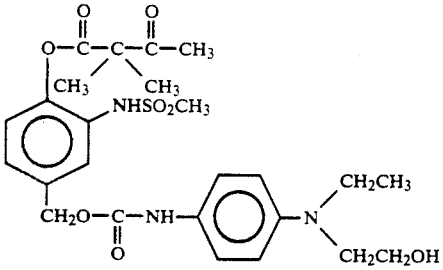
29)
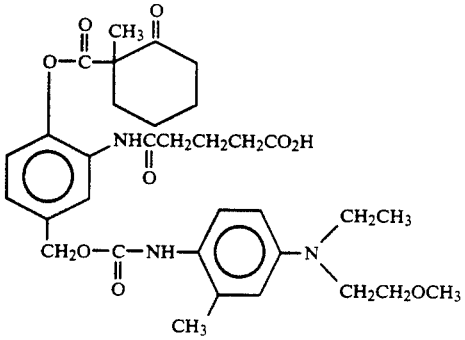
-continued
30)
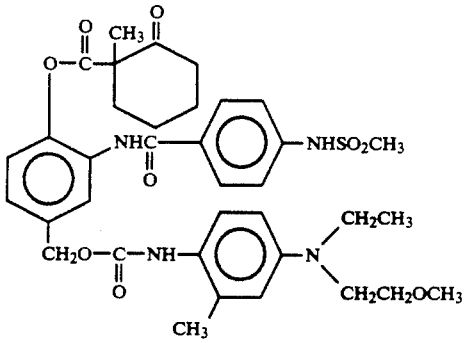
31)
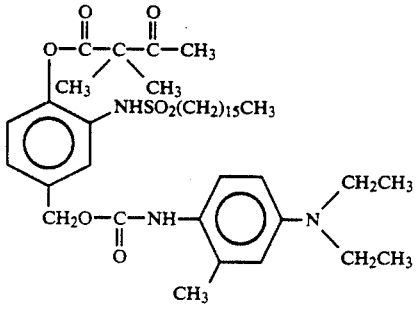
32)
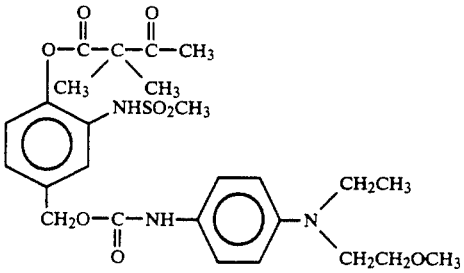
33)
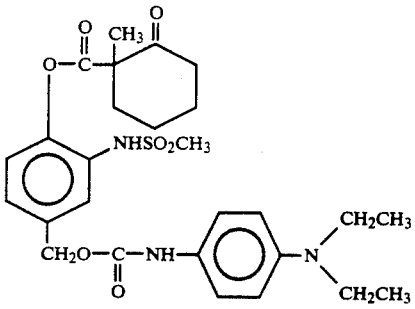
34)
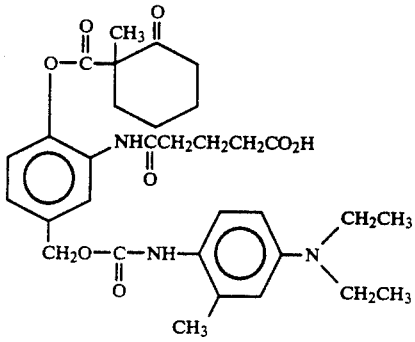

-continued

35)

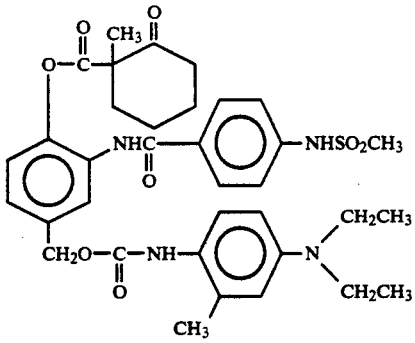

36)

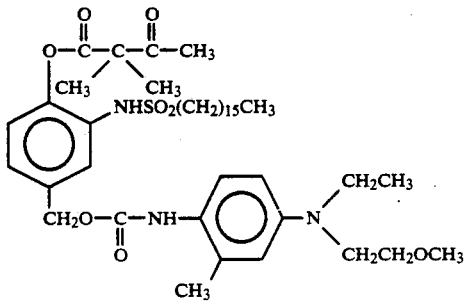

37)

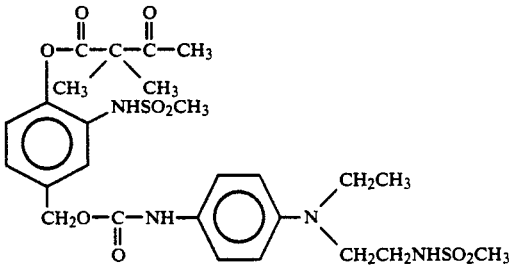

The coated blocked developing agent should be present in an amount sufficient to provide a useful density from the resulting dye image. Depending on the release efficiency, the development efficiency, the catalytic efficiency, the efficiency of dye formation, etc., the amount of blocked developer is usually in the range from about 50–5000 mg/m$^2$ (0.1–10 mmol/m$^2$).

The incorporation of the blocked developing agent into the photographic element can be carried out using conventional techniques. A typical method uses colloidal gelatin dispersions of the blocked developing agent which are prepared by means well known in the art. In general, the blocked developing agent is dissolved in a high vapor pressure organic solvent, for example, ethyl acetate, along with, in some cases, a low vapor pressure organic solvent, for example, dibutylphthalate, and then emulsified with an aqueous surfactant gelatin solution. After emulsification, usually done with a colloid mill, the high vapor pressure organic solvent is removed by evaporation or by washing, as is well known in the art. Conventional ball-milling techniques also can be used to incorporate the blocked developing agents.

An improved method for incorporating the blocked developing agents according to the present invention into a photographic element is disclosed by Texter Travis, and Mooberry in U.S. patent application Ser. No. 07/810,232, filed concurrently with the present application and incorporated herein by reference.

According to this improved incorporation method, a dispersion comprising solid particles of the blocked developing agent and a vehicle in which the solid particles are insoluble is utilized to incorporate the blocked developer into the photographic element. The solid particles are of microscopic size of less than about 10 μm in the largest dimension. The dispersion vehicle can be any vehicle in which the blocked developing agent is not soluble, such as an aqueous liquid having a pH low enough for the blocked developing agent to be insoluble, an organic solvent in which the blocked developing agent is insoluble, a monomer, or a polymeric binder. An example of such a vehicle is a gelatin coating solution. The dispersion is useful for incorporation into a layer having a polymeric film-forming binder known in the art, such as a hydrophilic colloid binder in a photographic material.

When incorporated as a solid particle dispersion, the blocked developing agents may be located in any layer of the photographic element that is accessible by diffusion to a sensitized layer or layers containing silver salts (such as silver halide). It is particularly advantageous to locate them in layers where they will readily contact processing fluid during the development process.

The solid particle dispersion can be formed by techniques well-known in the art. These techniques include precipitating or reprecipitating the blocked developing agent in the form of a dispersion, and/or milling techniques, such as ball-milling, sand-milling or media-milling the solid blocked developing agent in the presence of a dispersing agent. Reprecipitation techniques, for example, dissolving the blocked developing agent and precipitating by changing the solvent and/or pH of the solution in the presence of a surfactant, are well-known in the art. Milling techniques are well-known in the art and are described, for example, in U.S. Pat. No. 4,006,025. The blocked developing agents in the dispersion should have a largest dimension of less than about 10 μm and preferably less than about 1 μm. The blocked developing agents can be conveniently prepared in sizes ranging down to about 0.001 μm or less.

The support of the element of the invention can be any of a number of well-known supports for photographic elements. These include polymeric films, such as cellulose esters (for example, cellulose triacetate and diacetate) and polyesters of dibasic aromatic carboxylic acids with divalent alcohols (for example, polyethylene terephthalate), paper, and polymer-coated paper.

The photographic elements according to the invention can be coated on the selective supports as described in Research Disclosure Section XVII and the references cited therein.

Multicolor photographic elements according to the invention generally comprise a blue-sensitive silver halide layer having at least one yellow image dye-forming coupler associated therewith, a green-sensitive silver halide layer having at least one magenta image dye-forming coupler associated therewith, and a red-sensitive silver halide layer having at least one cyan dye-forming image coupler associated therewith. Color-forming couplers are described in Research Disclosure Section VII, paragraphs D, E, F and G and the publications cited therein. Particularly useful couplers include pivaloylacetanilide or phenylacetanilide yellow image dye-forming couplers, pyrazolone or pyrazolotriazole magenta image dye-forming couplers and naphtholic or phenolic cyan image dye-forming couplers. These couplers can be incorporated in the elements and emulsions as described in Research Disclosure Section VII, paragraph C and the publications cited therein.

A photographic element according to the invention or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

Photographic elements according to the invention can be exposed to actinic radiation, typically in the visible region of the spectrum, to form a latent image as described in Research Disclosure Section XVIII, and then processed to form a visible dye image.

The photographic element according to the present invention is developed by contacting via conventional techniques the exposed photographic element with an activator solution at a pH ranging from about 9 to 14. The activator solution includes at least one dinucleophile reagent for unblocking the developing agent, at least one oxidizing agent for amplification and alkali for activating the coupling chemistry. As explained previously, hydrogen peroxide activator solution is particularly preferred since hydrogen peroxide is both a dinucleophile reagent and an oxidizing agent. Additionally preferred are any of the above-described dinucleophile reagents which can also act as an oxidizing agent in the amplification process, such as, for example, perborate. It is also possible to employ an activator solution which includes one compound as the dinucleophile and a second compound as the oxidizing agent, although this is less advantageous.

The activator solution should be buffered with a conventional buffering agent. Preferred for use with the present invention is a carbonate or borate-buffered activator solution. Particularly advantageous is a carbonate-buffered hydrogen peroxide activator solution. To prevent degradation of the activator solution, particularly hydrogen peroxide activator solutions, via metal ion contaminants, known metal ion sequestering agents can be added to the activator solution. Exemplary metal ion sequestrants include 1-hydroxyethyl-1,1-diphosphonic acid and diethylenetriamine penta-acetic acid.

A preferred activator solution includes about 0.1 to 3.0 wt% hydrogen peroxide, about 0.2 to 2.0 wt% surfactant, about 5 to 50 g/L $K_2CO_3$, about 1 to 10 g/L KODAK PHOTO-FLO 200, about 0.1 to 5 g/L 1-hydroxyethyl-1,1-diphosphonic acid and about 0.1 to 5 g/L diethylenetriamine penta-acetic acid.

Development is followed by the conventional steps of bleaching, fixing, or bleach-fixing to remove silver and silver halide, washing and drying. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The blocked color developing agents for utilization in the present invention can be prepared by methods known in the organic synthesis arts. Typically, they are prepared according to the following exemplary scheme:

Scheme A

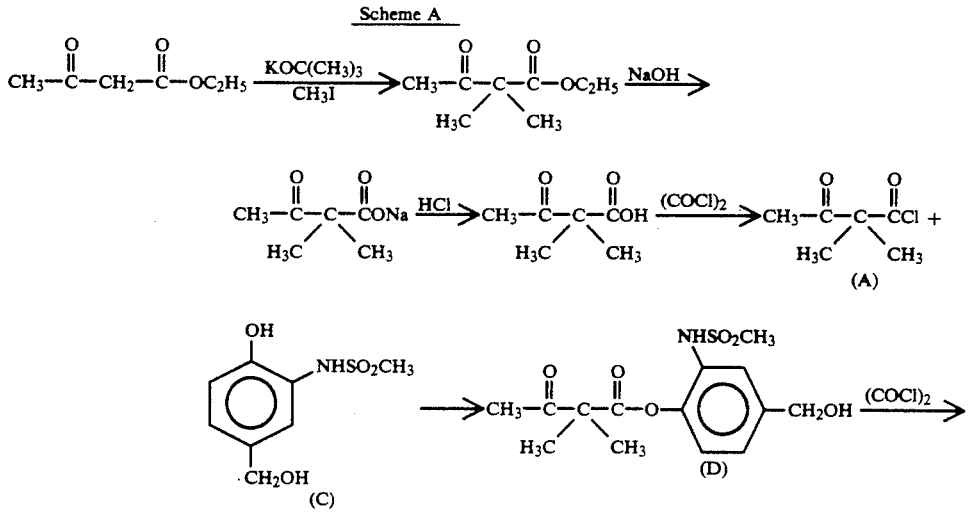

-continued

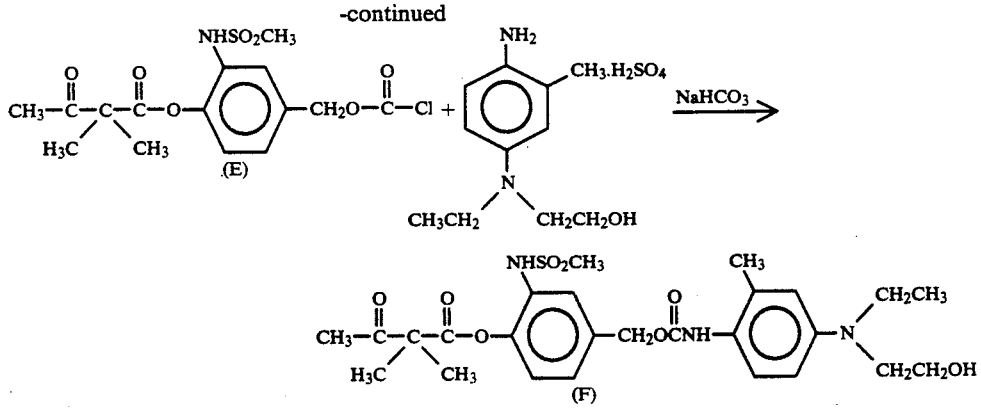

Scheme B

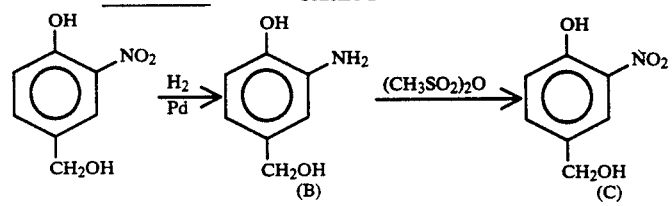

SYNTHESIS EXAMPLE

Preparation of compound (1) Preparation of (A)

A 2 liter, 3-necked round-bottomed flask containing ethyl acetoacetate (65 g, 0.5 mole), t-butanol (200 ml), and tetrahydrofuran (200 ml) was fitted with thermometer, mechanical stirrer, nitrogen inlet, and addition funnel topped with an ice water condenser. The mixture was cooled to 0° C. and stirred vigorously under a slow nitrogen stream while adding potassium t-butoxide (56 g, 0.5 mole) slowly (temp. <20° C.). A homogeneous solution resulted after about 5 minutes. Methyl iodide (32 ml, 0.5 mole) was added via the addition funnel while the temperature rose to about 10° C. The ice bath was replaced with a water bath at room temperature (20° C.) before stirring the mixture for an additional 30 minutes while potassium iodide precipitated. The mixture was cooled again to 0° C. before adding more methyl iodide (40 ml) and then potassium t-butoxide (56 g, 0.5 mole) (temp. <30° C.). The mixture was stirred at room temperature for 48 hours and then diluted with about 1 liter of water and 0.5 liter of saturated NaCl solution before the mixture was extracted with ether. The ether solution was washed with 0.1N NaOH and then with 1N HCl, dried over magnesium sulfate, and concentrated to an oil. The crude dimethylated ethyl acetoacetate (64 g. 81% yield) had an nmr spectrum that was consistent with the expected compound.

The crude dimethylated ester (64 g, approx. 0.4 mole), NaOH (48 g, 1.2 mole), water (320 ml), and a trace of indicator dye (Metanil Yellow) were stirred for 18 hours until a homogeneous solution resulted. Residual alkali-insoluble material was removed by washing with a small amount of ether. The alkaline solution was then cooled in ice water and neutralized carefully with concentrated HCl (approx. 100 ml) until the indicator dye turned purple. Saturated NaCl was added to the cold solution before extracting several times with methylene chloride. The extracts were dried over sodium sulfate, filtered and concentrated at 30° C. to yield the crude acid as an oil (50 g) (the acid solidifies at ice temperatures). The nmr spectrum showed that a small amount of ethanol was present in the crude acid. In order to avoid excessive decarboxylation, the acid was used immediately by reacting with oxalyl chloride (75 ml, 0.86 mole) and a trace of triethylamine at room temperature for 24 hours. The mixture was concentrated at 30° C. using a rotary evaporator with water aspirator vacuum. Excess oxalyl chloride was removed by codistillation with methylene chloride to yield crude 2,2-dimethyl-3-oxobutyryl chloride (A) (49 g, 82%). A portion of the crude (45 g) was distilled through a six inch Vigreaux column under water aspirator vacuum (bp 50°-55° C.) to yield purified colorless product (30 g, 67%). A small amount of impurity containing an ethoxy group distilled with the later fractions of product. This impurity could be avoided by complete removal of ethanol prior to acid chloride formation.

Preparation of (B)

Commercially available 3-nitro-4-hydroxybenzyl alcohol (16.9 g, 0.1 mole) was hydrogenated (3 atm) in dioxane (300 ml) using g of 5% Pd on carbon as catalyst. After the catalyst was filtered off, the solution was concentrated to form (B) as a crystalline solid (10 g, 72%).

Preparation of (C):

Aminophenol (B) (2.78 g., 0.02 mole) and 2,6-lutidine (2.36 g, 0.022 mole) were mixed with p-dioxane (40 ml). Methanesulfonic anhydride (3.48 g 0.02 mole) was then added. After ½ hour, the mixture was diluted with ethyl acetate and washed twice with salt water (100 ml of saturated NaCl plus 15 ml of 1N HCl). After drying over $MgSO_4$, the ethyl acetate extract was concentrated to a solid residue. Crystallization from ethyl acetate:heptane yielded 3.2g (75%) of product (C).

Preparation of (D)

A homogeneous solution of triethylamine (11.2 ml, 0.08 mole) and phenolic compound (C) (10.9 g, 0.05 mole) in tetrahydrofuran (100 ml) was cooled to −20° C. under a nitrogen atmosphere. A solution of acid chloride (A) (7.5 g, 0.05 mole) in methylene chloride (50 ml) was then added. The mixture was warmed to room temperature for a few minutes, diluted with more solvent, and washed with 0.1N HCl. The organic layer was dried with magnesium sulfate and concentrated to an oil (D) (17.5g) which contained a small amount of solvent but was pure enough for use in the next step.

Preparation of (E)

The alcohol (D) (17 g, 0.052 mole) was stirred with methylene chloride (100 ml) and phosgene (60 ml of toluene solution containing 0.125 moles of $COCl_2$) for 2 hours at RT. The mixture was concentrated at 40° C. under reduced pressure to 21.6g of syrupy product (E) which solidified in the refrigerator.

Preparation of (F)

Color developer [4-(N-ethyl-N-2-hydroxyethyl)-2-methylphenylenediamine sulfate, 17.5 g, 0.06 mole] was added to a vigorously stirred mixture of methylene chloride (60 ml) and 1M aqueous sodium bicarbonate (200 ml) cooled in ice water. Solid chloroformate (E) (11.8 g, 0.03 mole) was added to the cold solution and the mixture was stirred for 30 min. The organic phase was separated, washed twice with 100 ml portions of water (pH of aqueous phase adjusted to 5 with HCl), dried over $MgSO_4$, and concentrated to an oil at 30° C. Silica gel chromatography using 1:1 diethyl ether:-methylene chloride as eluent yielded color developing agent (F) (compound 1) as an amorphous solid (11 g).

Using a similar synthesis procedure, other blocked color developing agents useful according to the present invention, such as exemplary agents 2–11, can be prepared.

Test 1

For testing purposes, photographic elements were prepared by coating the following layers onto a film support:

Emulsion layer:

Gelatin at 2690 mg/m²

Red-sensitized silver chloride at 129 mg/m² (as Ag)

Cyan image coupler X dispersed in dibutyl phthalate at 806 mg/m²

Blocked developer 1 (dispersed in ethyl acetate) at 1.72 mmol/m²

Overcoat:

Gelatin at 1075 mg/m²

Bisvinylsulfonylmethyl ether at 1.5% total gelatin

Photographic elements also were prepared in which blocked developer 1 was replaced by control compound Y and non-blocked color developing agent W, respectively.

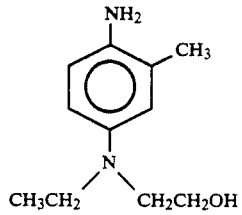

(W)

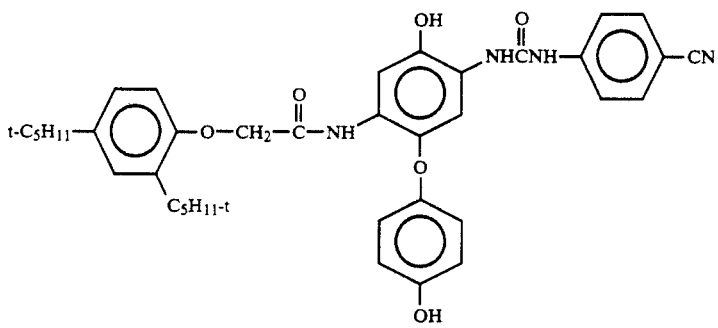

(X)

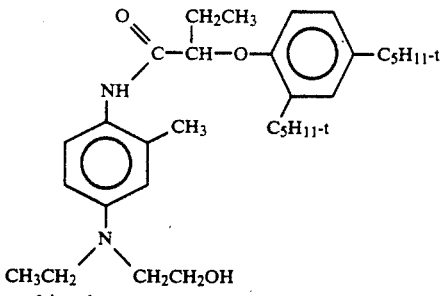

(Y)

Strips of each element were exposed to white light through a graduated density step tablet and then processed for 2 minutes at 24° C. in an activator solution, followed by a 5 minute rinse in distilled water, and dried. Two different activator solutions were employed; one was a pH 10 borate buffer and the other was a pH 10 borate buffer which included 0.6 wt% hydrogen peroxide. Processed images were read with red light (status M densitometry) to record $D_{min}$, $D_{max}$ and relative speed data, which are presented in Table I.

TABLE I

| Compound | $D_{min}$ | $D_{max}$ | Relative Speed |
|---|---|---|---|
| Activator: pH 10 buffer with hydrogen peroxide | | | |
| 1 | 0.10 | 0.80 | 0 |
| Y | 0.03 | 0.04 | — |
| W | 0.30 | 2.10 | −1.10 log E |
| Activator: pH 10 buffer | | | |
| 1 | 0.03 | 0.06 | — |
| Y | 0.03 | 0.03 | — |
| W | 0.35 | 0.79 | −1.20 log E |

The data in Table I demonstrate that a photographic element containing blocked agent 1 of the present invention forms a dye image when the activator solution includes the dinucleophile hydrogen peroxide, but does not form a significant image when the activator solution does not contain a dinucleophile. This behavior can be contrasted with that obtained for photographic elements containing control compound Y and non-blocked color developing agent W. With respect to control compound Y, essentially no image is obtained with either activator solution. With respect to non-blocked color developing agent W, an image accompanied by severe speed losses (desensitization) is obtained regardless of whether the activator solution includes a dinucleophile. Severe desensitization accompanying the incorporation of non-blocked conventional color developers, such as W, is well-known in the art.

Test 2

Photographic elements as described in Test 1 were stored for one and two week periods at 100° F. and 50% relative humidity. Strips of each element were exposed and processed as described in Test 1, and the resulting sensitometric data are listed in Table II.

TABLE II

| Compound | $D_{min}$ | $D_{max}$ | Relative Speed |
|---|---|---|---|
| Activator: pH 10 buffer with 0.3% hydrogen peroxide | | | |
| Fresh | | | |
| 1 | 0.19 | 0.60 | 0 |
| W | 0.38 | 1.95 | −1.37 log E |
| 1 week incubation | | | |
| 1 | 0.18 | 0.55 | 0 |
| W | 0.74 | 1.72 | −1.59 log E |
| 2 week incubation | | | |
| 1 | 0.09 | 0.35 | 0 |
| W | 0.89 | 1.62 | −1.67 log E |

The data in Table II show that photographic elements made with compounds of the present invention have a degree of storage stability which far surpasses that obtained by the direct incorporation of conventional non-blocked color developers.

Test 3

Photographic elements which included blocked developing agents 1, 2, 4 and 5 were prepared as described in Test 1. Strips of each element were exposed as described in Test 1 and processed in a pH 10 borate-buffered activator solution which included 0.45 wt% hydrogen peroxide. Strips of each element also were exposed as described in Test 1 and processed in a 2 wt% sodium perborate activator solution (Aldrich catalog no. 24,412-0). The strips were developed for 5 minutes, washed and dried. The processed images were read with red light (status M densitometry) to record $D_{min}$, $D_{max}$ and relative speed. The resulting sensitometric data are listed in Table III.

TABLE III

| Agent | $D_{min}$ | $D_{max}$ | Relative Speed |
|---|---|---|---|
| Activator: pH 10 buffer with hydrogen peroxide | | | |
| 1 | 0.24 | 0.90 | — |
| 2 | 0.11 | 0.45 | +0.15 log E |
| 4 | 0.17 | 0.70 | +0.15 log E |
| 5 | 0.30 | 1.10 | +0.15 log E |
| Activator: 2% sodium perborate | | | |
| 1 | 0.30 | 0.90 | — |
| 2 | 0.10 | 0.40 | −0.07 log E |
| 4 | 0.17 | 0.70 | +0.15 log E |
| 5 | 0.35 | 1.03 | +0.15 log E |

These data in Table III illustrate that alternative dinucleophiles can unblock the blocked color developing agent and amplify the resulting image.

Test 4

Photographic elements were prepared by coating the following layers on a reflection support:

Emulsion layer:

Gelatin at 2690 mg/m$^2$

Red-sensitized silver chloride at 32 mg/m$^2$ (as Ag)

Cyan image coupler of formula Z dispersed in dibutyl phthalate at 860 mg/m$^2$

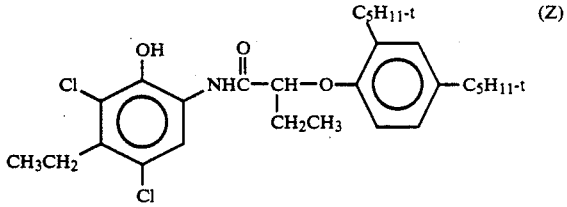

(Z)

Blocked developing agent 7, 8 or 9 at 1.6 mmol/m$^2$

Overcoat:

Gelatin at 1075 mg/m$^2$

Bisvinylsulfonylmethyl ether at 1.6% total gelatin

Strips of each element were exposed to white light through a graduated density steptablet and then processed for 90 seconds at 77° F. in an activator solution, followed by a 1 minute bleach-fix (KODAK EKTAPRINT 2), a 5 minute rinse in distilled water and dried. The activator solution was a pH 11 potassium carbonate (50 g/L) buffer which included 0.6 wt% hydrogen peroxide, 0.1 wt% 1-hydroxyethyl-1,1-diphosphonic acid, 0.1 wt% diethylenetriamine penta-acetic acid and 1.0 wt% KODAK PHOTO-FLO 200. Processed images were read with red light (status A densitometry) to record $D_{min}$, $D_{max}$ and relative speed data; these data are presented in Table IV. All three agents according to the invention yielded appreciable $D_{max}$, with respectively low $D_{min}$.

TABLE IV

| Agent | $D_{min}$ | $D_{max}$ | Relative Speed |
|---|---|---|---|
| 7 | 0.22 | 2.08 | — |
| 8 | 0.13 | 1.28 | +0.01 log E |
| 9 | 0.14 | 1.06 | −0.29 log E |

Test 5

Photographic elements which included blocked developing agent 7 were prepared and exposed as described in Test 4. Coatings were processed at various time intervals over a six hour period, to test the stability of the activator solution. The activator solution included 50 g/L $K_2CO_3$, 1 g/L 1-hydroxyethyl-1,1-diphosphonic acid, 1 g/L diethylenetriamine pentaacetic acid, 10 g/L KODAK PHOTO-FLO 200 and 0.6 wt% hydrogen peroxide. Processed images were read with red light (status A densitometry) to record $D_{min}$, $D_{max}$ and relative speed data; these data are presented in Table V.

TABLE V

| Time (min) | $D_{min}$ | $D_{max}$ | Relative Speed |
|---|---|---|---|
| 3 | 0.26 | 1.72 | — |
| 18 | 0.25 | 1.78 | +0.02 log E |
| 33 | 0.26 | 1.76 | 0 |
| 63 | 0.25 | 1.70 | 0 |
| 93 | 0.24 | 1.72 | +0.01 log E |
| 123 | 0.25 | 1.74 | +0.02 log E |
| 173 | 0.27 | 1.78 | −0.02 log E |
| 243 | 0.25 | 1.74 | −0.01 log E |
| 303 | 0.26 | 1.74 | −0.03 log E |
| 360 | 0.28 | 1.77 | −0.01 log E |

The data of Table V show that an activator solution containing hydrogen peroxide can perform satisfactorily over an extended time period without significant degradation when the color developing agent is incorporated in the film rather than in the activator solution. Incorporation of the developer in the film obviates the need for consecutive developer and activator processing stages, as has been utilized in the prior art.

The invention has been described in detail with particular reference to certain preferred embodiments thereof, but it will be understood that variations and modifications can be effected within the spirit and scope of the invention.

What is claimed is:

1. A color photographic element comprising a support bearing at least one photographic silver halide emulsion layer and an image dye-forming coupler wherein:

(a) the photographic silver halide in the emulsion layer comprises at least about 70 mole percent chloride;

(b) the concentration of silver in the emulsion layer is within the range of about 0.1 mg/m$^2$ to 2000 mg/M$^2$; and (c) the element includes a blocked color developing agent capable of being unblocked during photographic processing by means of reaction with a dinucleophile reagent.

2. A color photographic element according to claim 1, wherein the emulsion layer further comprises at least one additional silver halide selected from the group consisting of silver bromide, silver iodide, silver chlorobromide, silver chloroiodide and silver bromoiodide.

3. A color photographic element according to claim 1, wherein the silver halide in the emulsion layer comprises at least about 95 mole percent chloride.

4. A color photographic element according to claim 3, wherein the concentration of blocked color developer in said element is about 0.1 to 10 mmol/m$^2$.

5. A color photographic element according to claim 1, wherein the concentration of silver in the emulsion layer is within the range of about 5 mg/m$^2$ to 500 mg/m$^2$.

6. A color photographic element according to claim 1, wherein the blocked developing agent is selected from the group consisting of a blocked phenylenediamine color developing agent and a blocked aminophenol color developing agent.

7. A color photographic element according to claim 1, wherein the blocked color developing agent has a structure represented by the formula

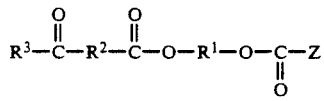

wherein

Z represents the atoms completing a color developing agent which is releasable from the remainder of the molecule by means of reaction with a dinucleophile reagent;

$R^1$ is an unsubstituted or substituted alkylene or arylene group;

$R^2$ is a substituted or unsubstituted carbon or nitrogen atom that provides a distance between the carbonyl groups that enables a nucleophilic displacement reaction to occur upon processing a photographic element containing the blocked developing agent in the presence of a dinucleophile reagent; and $R_3$ is an unsubstituted or substituted alkyl or aryl group, or represents with $R^2$ the atoms necessary to complete a 5- or 6-member ring.

8. A color photographic element according to claim 7, wherein the blocked developing agent has a structure represented by the formula

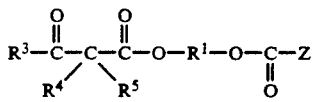

wherein $R^4$ and $R^5$ are each individually an alkyl group, an aryl group, an arylalkyl group, an alkoxy group or an alkoxyaryl group.

9. A color photographic element according to claim 7, wherein the blocked developing agent has a structure represented by the formula

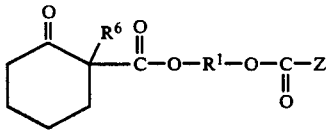

wherein $R^6$ is an alkyl group, an aryl group, an arylalkyl group, an alkoxy group or an alkoxyaryl group.

10. A color photographic element according to claim 1, wherein the blocked developing agent has a structure represented by the formula

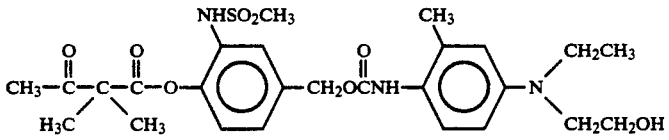

or

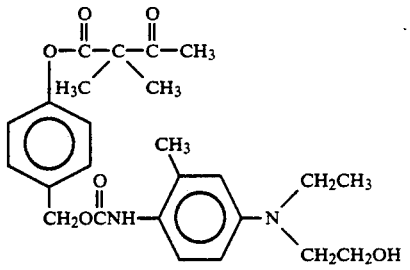

11. A color photographic element according to claim 1, wherein the blocked developing agent is incorporated into the photographic element in the form of a dispersion comprising solid particles of the blocked developing agent and a vehicle in which the solid particles are insoluble.

12. A color photographic element according to claim 11, wherein the size of the solid particles is less than about 10 μm in the largest dimension.

13. A color photographic element according to claim 1, further comprising at least one blue-sensitive silver chloride emulsion layer comprising at least one pivaloylacetanilide or phenylacetanilide yellow image dye-forming coupler; at least one green-sensitive silver chloride emulsion layer comprising at least one pyrazolone or pyrazolotriazole magenta image dye-forming coupler; and at least one red-sensitive silver chloride emulsion layer comprising at least one naphtholic or phenolic cyan image dye-forming coupler, wherein the element comprises at least one layer comprising a blocked phenylenediamine color developing agent that is capable of being unblocked during photographic processing by means of reaction with hydrogen peroxide.

14. A process of forming and amplifying a photographic color image in an exposed color photographic element comprising developing the element in the presence of a dinucleophile reagent, wherein the element comprises a support bearing at least one photographic silver halide emulsion layer and an image dye-forming coupler wherein:

(a) the photographic silver halide in the emulsion layer comprises at least about 70 mole percent chloride;

(b) the concentration of silver in the emulsion layer is within the range of about 0.1 mg/m$^2$ to 2000 mg/m$^2$; and (c) the element includes a blocked color developing agent capable of being unblocked by means of reaction with the dinucleophile reagent.

15. A process of forming and amplifying a photographic color image according to claim 14, wherein the dinucleophile reagent is hydrogen peroxide.

16. A process of forming and amplifying a photographic color image according to claim 15, wherein the developing step comprises contacting the exposed element with a solution having a pH of about 9 to 14 and comprising hydrogen peroxide and at least one buffer selected from the group consisting of a carbonate and a borate.

17. A process of forming and amplifying a photographic color image according to claim 16, wherein the solution further comprises at least one metal ion sequestering agent.

18. A process of forming and amplifying a photographic color image according to claim 14, wherein the blocked color developing agent has a structure represented by the formula

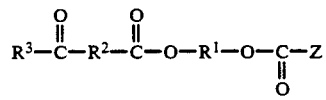

wherein

Z represents the atoms completing a color developing agent which is releasable from the remainder of the molecule by means of reaction with a dinucleophile reagent;

$R^1$ is an unsubstituted or substituted alkylene or arylene group;

$R^1$ is a substituted or unsubstituted carbon or nitrogen atom that provides a distance between the carbonyl groups that enables a nucleophilic displacement reaction to occur upon processing a photographic element containing the blocked developing agent in the presence of a dinucleophile reagent; and $R_3$ is an unsubstituted or substituted alkyl or aryl group, or represents with $R^2$ the atoms necessary to complete a 5- or 6-member ring.

* * * * *